US006624786B2

(12) United States Patent
Boyle

(10) Patent No.: US 6,624,786 B2
(45) Date of Patent: Sep. 23, 2003

(54) DUAL BAND PATCH ANTENNA

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/864,131

(22) Filed: May 24, 2001

(65) Prior Publication Data

US 2001/0035843 A1 Nov. 1, 2001

(30) Foreign Application Priority Data

Jun. 1, 2000 (GB) ..... 0013156

(51) Int. Cl.[7] ..... H01Q 1/38
(52) U.S. Cl. ..... 343/700 MS; 343/745
(58) Field of Search ..... 343/700 MS, 702, 343/745, 749

(56) References Cited

U.S. PATENT DOCUMENTS

| | | | | | |
|---|---|---|---|---|---|
| 3,909,517 | A | * | 9/1975 | Clemens | 369/126 |
| 4,259,670 | A | * | 3/1981 | Schiavone | 343/700 MS |
| 4,366,484 | A | * | 12/1982 | Weiss et al. | 333/229 |
| 4,367,474 | A | | 1/1983 | Schaubert et al. | 343/700 |
| 4,386,357 | A | * | 5/1983 | Patton | 343/700 MS |
| 4,777,490 | A | | 10/1988 | Sharma et al. | 343/754 |
| 4,827,266 | A | * | 5/1989 | Sato et al. | 343/700 MS |
| 5,764,190 | A | * | 6/1998 | Murch et al. | 343/702 |
| 6,177,908 | B1 | * | 1/2001 | Kawahata et al. | 343/700 MS |
| 6,297,776 | B1 | * | 10/2001 | Pankinato | 343/700 MS |
| 6,326,919 | B1 | * | 12/2001 | Diximus et al. | 343/700 MS |

FOREIGN PATENT DOCUMENTS

DE 19822371 A 11/1999 ..... H01Q/1/24

OTHER PUBLICATIONS

S. Maci et al. Entitled "Dual–Frequency Patch Antennas", IEEE Antennas and Propagation Magazine, vol. 39, No. 6, Dec. 1, 1997, pp. 13–20.

* cited by examiner

*Primary Examiner*—Tan Ho
(74) *Attorney, Agent, or Firm*—Jack D. Slobod

(57) ABSTRACT

A dual band patch antenna (700) comprises a conventional patch conductor (106) having a resonant circuit (702, 704) connected between the patch conductor and a ground conductor (102). The resonant circuit (702, 704) modifies the behavior of the antenna (700) in the vicinity of its resonant frequency, thereby providing a dual band antenna in which both bands can be used simultaneously. The total radiating bandwidth of the dual band antenna is significantly greater than that of an equivalent antenna having no resonant circuits. Additional resonant circuits can be employed to provide a multi-band antenna.

11 Claims, 4 Drawing Sheets

DUAL BAND PATCH ANTENNA

BACKGROUND OF THE INVENTION

1. Field of the Invention

The present invention relates to a patch antenna for a radio communications apparatus capable of dual band operation. In the present specification, the term dual band antenna relates to an antenna which functions satisfactorily in two (or more) separate frequency bands but not in the unused spectrum between the bands.

2. Description of the Related Art

A patch antenna as known in the art comprises a substantially planar conductor, often rectangular or circular in shape. Such an antenna is fed by applying a voltage difference between a point on the antenna and a point on a ground conductor. The ground conductor is often planar and substantially parallel to the antenna, such a combination often being called a Planar Inverted-F Antenna (PIFA). When used in a cordless or cellular telephone handset, the ground conductor is generally provided by the handset body. The resonant frequency of a patch antenna can be modified by varying the location of the feed points and by the addition of extra short circuits between the conductors.

There are several advantages to the use of patch antennas in cordless or cellular telephone handsets, in particular a compact shape and good radiation patterns. However, the bandwidth of a patch antenna is limited and there is a direct relationship between the bandwidth of the antenna and the volume that it occupies.

Cellular radio communication systems typically have a 10% fractional bandwidth, which requires a relatively large antenna volume. Many such systems are frequency division duplex in which two separate portions of the overall spectrum are used, one for transmission and the other for reception. In some cases there is a significant portion of unused spectrum between the transmit and receive bands. For example, for UMTS (Universal Mobile Telecommunication System) the uplink and downlink frequencies are 1900–2025 MHz and 2110–2170 MHz respectively (ignoring the satellite component). This represents a total fractional bandwidth of 13.3% centred at 2035 MHz, of which the uplink fractional bandwidth is 6.4% centred at 1962.5 MHz and the downlink fractional bandwidth is 2.8% centred at 2140 MHz. Hence, approximately 30% of the total bandwidth is unused. If an antenna having a dual resonance could be designed, the overall bandwidth requirement could therefore be reduced and a smaller antenna used.

One known solution, disclosed in U.S. Pat. No. 4,367,474 and U.S. Pat. No. 4,777,490, is the provision of a short circuit between the conductors whose position is changed by switching using diodes, thereby enabling the operating frequency of the antenna to be switched. However, diodes are non-linear devices and may therefore generate intermodulation products. Further, in systems such as UMTS it is required to have simultaneous transmission and reception, so such switching is not acceptable.

BRIEF SUMMARY OF THE INVENTION

An object of the present invention is to provide a patch antenna having dual band operation without switching.

According to a first aspect of the present invention there is provided a dual band patch antenna for a radio communications apparatus, comprising a substantially planar patch conductor, wherein a resonant circuit is connected between a point on the patch conductor and a point on a ground conductor.

According to a second aspect of the present invention there is provided a radio communications apparatus including an antenna made in accordance with the present invention.

The present invention is based upon the recognition, not present in the prior art, that by connecting a resonant circuit between a point on the patch conductor and a point on the ground conductor, the behaviour of the patch antenna is modified to provide dual band operation without the need for switching. Such an arrangement has the advantage that it can be passive and enables simultaneous transmission and/or reception in both frequency bands.

A patch antenna made in accordance with the present invention is suitable for a wide range of applications, particularly where simultaneous dual band operation is required. Examples of such applications include UMTS and GSM (Global System for Mobile communications) cellular telephony handsets, and devices for use in a HIPERLAN/2 (High PErformance Radio Local Area Network type 2) wireless local area network.

An unexpected advantage of a patch antenna made in accordance with the present invention is that the combined bandwidth of the two (or more) resonances is significantly greater than the bandwidth of an unmodified patch antenna without a resonant circuit. This advantage greatly enhances its suitability for use in typical wireless applications.

BRIEF DESCRIPTION OF THE DRAWINGS

Embodiments of the present invention will now be described, by way of example, with reference to the accompanying drawings, wherein.

In the drawings the same reference numerals have been used to indicate corresponding features.

DETAILED DESCRIPTION OF THE INVENTION

Figure 1:
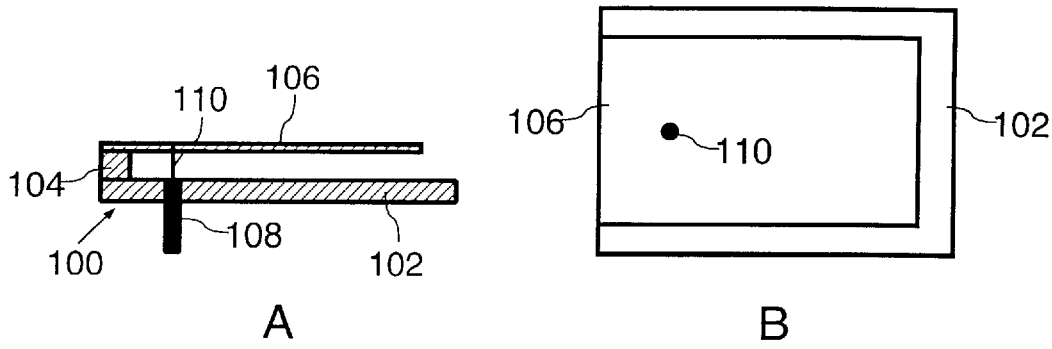
FIG. 1 is a cross-section (part A) and a top view (part B) of a patch antenna.

FIG. 1 illustrates an embodiment of a quarter wave patch antenna 100, part A showing a cross-sectional view and part B a top view. The antenna comprises a planar, rectangular ground conductor 102, a conducting spacer 104 and a planar, rectangular patch conductor 106, supported substantially parallel to the ground conductor 102. The antenna is fed via a co-axial cable, of which the outer conductor 108 is connected to the ground conductor 102 and the inner conductor 110 is connected to the patch conductor 106.

The ground conductor 102 has a width of 40 mm, a length of 47 mm and a thickness of 5 mm. The patch conductor has a width of 30 mm, a length of 41.6 mm and a thickness of 1 mm. The spacer 104 has a length of 5 mm and a thickness of 4 mm, thereby providing a spacing of 4 mm between the conductors 102, 106. The cable 110 is connected to the patch conductor 106 at a point on its longitudinal axis of symmetry and 10.8 mm from the edge of the conductor 106 attached to the spacer 104.

Figure 2:
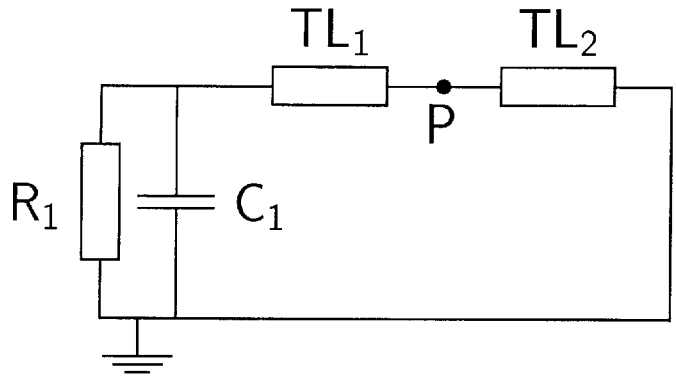
FIG. 2 is an equivalent circuit for modelling the patch antenna of FIG. 1.

A transmission line circuit model, shown in FIG. 2, was used to model the behaviour of the antenna 100. A first transmission line section $TL_1$, having a length of 30.8 mm and a width of 30 mm, models the portion of the conductors 102, 106 between the open end (at the right hand side of parts A and B of FIG. 1) and the connection of the inner conductor 110 of the coaxial cable. A second transmission line section $TL_2$, having a length of 5.8 mm and a width of 30 mm, models the portion of the conductors 102, 106 between the connection of the inner conductor 110 and the edge of the spacer 104 (which acts as a short circuit between the conductors 102, 106).

Capacitance $C_1$ represents the edge capacitance of the open-ended transmission line, and has a value of 0.495 pF, while resistance $R_1$ represents the radiation resistance of the edge, and has a value of 1000Ω, both values determined empirically. A port P represents the point at which the co-axial cable 108, 110 is connected to the antenna, and a 50Ω load, equal to the impedance of the cable 108, 110, was used to terminate the port P in simulations.

Figure 3:
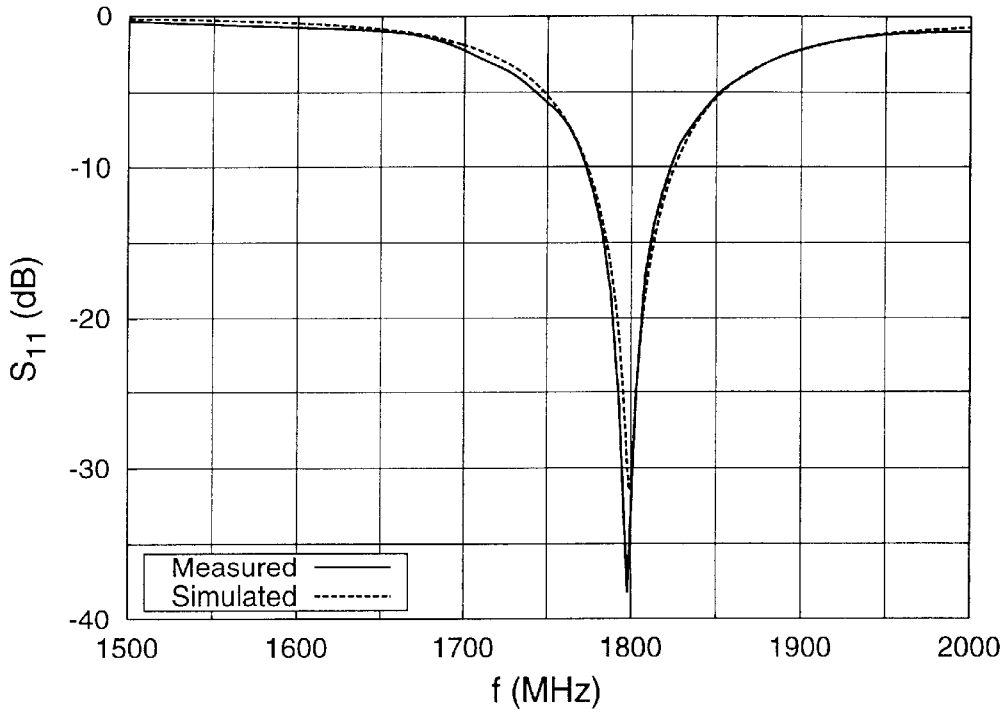
FIG. 3 is a graph of return loss $S_{11}$ in dB against frequency f in MHz for the patch antenna of FIG. 1, with measured results shown by a solid line and simulated results by a dashed line.

FIG. 3 compares measured and simulated results for the return loss $S_{11}$ of the antenna 100 for frequencies f between 1500 and 2000 MHz. Measured results are indicated by the solid line, while simulated results (using the circuit shown in FIG. 2) are indicated by the dashed line. It can be seen that there is very good agreement between measurement and simulation, particularly taking into account the simple nature of the circuit model. The fractional bandwidth at 7 dB return loss (corresponding to approximately 90% of input power radiated) is 4.3%.

Figure 4:
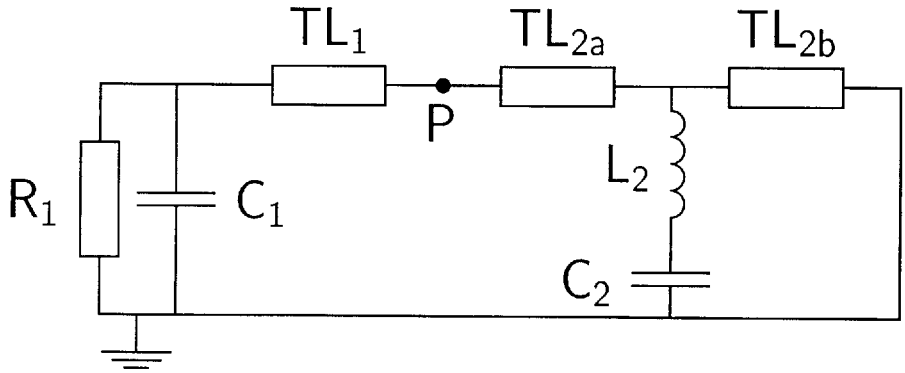
FIG. 4 is a modified equivalent circuit representing a dual resonant patch antenna.

A modification of the circuit of FIG. 2 is shown in FIG. 4, in which the second transmission line section $TL_2$ is divided into two sections, $TL_{2a}$ and $TL_{2b}$, and a resonant circuit is connected from the junction of these two circuits to ground. The resonant circuit comprises an inductance $L_2$ and a capacitance $C_2$, which has zero impedance at its resonant frequency, $1/(2\pi\sqrt{L_2C_2})$. In the vicinity of this resonant frequency the behaviour of the patch is modified, while at other frequencies its behaviour is substantially unaffected.

Simulations were performed varying the component values of the resonant circuit and its location until dual resonance was achieved at a fractional frequency spacing of 8.7%, which corresponds to the fractional separation between the UMTS transmit and receive bands. The resulting component values are that $L_2$ has a value of 1.95 nH and $C_2$ has a value of 3.7 pF, while the transmission line sections $TL_{2a}$ and $TL_{2b}$ have lengths of 4.1 mm and 1.7 mm respectively.

Figure 5:
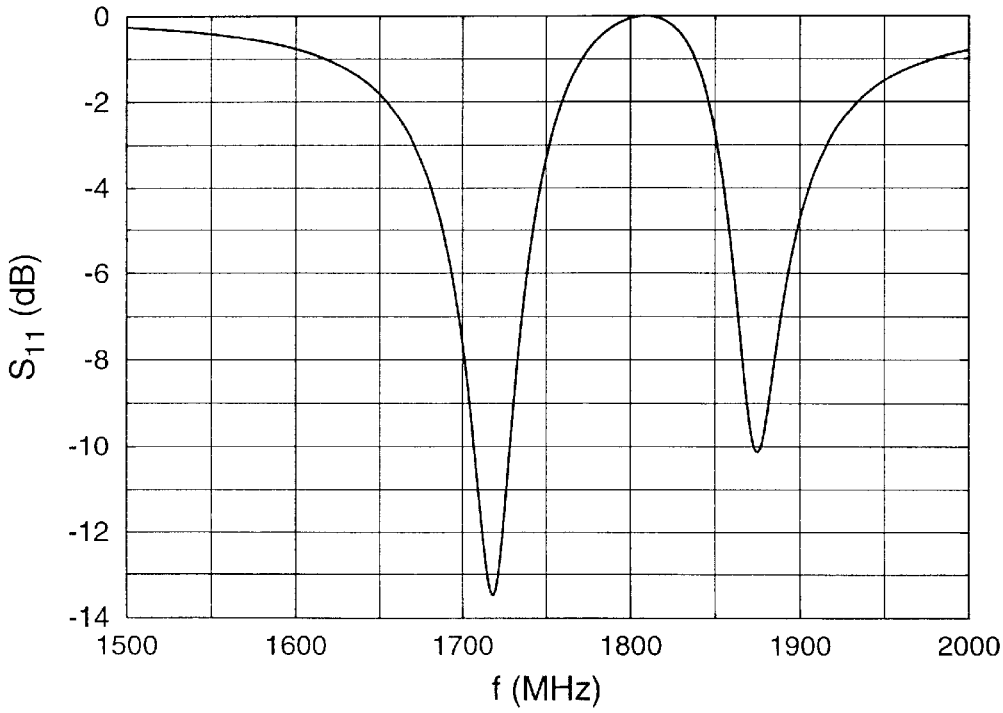
FIG. 5 is a graph of simulated return loss $S_{11}$ in dB against frequency f in MHz for the modified equivalent circuit of FIG. 4.

FIG. 5 shows the results for the return loss $S_{11}$, for frequencies f between 1500 and 2000 MHz. There are now two resonances, at frequencies of 1718 MHz and 1874 MHz. The lower of these corresponds the original resonant frequency reduced by the effect of the resonant circuit, while the higher corresponds to a new radiation band at a frequency close to the resonant frequency of the resonant circuit, which is 1873 MHz. The 7 dB return loss bandwidths are 2.2% and 1.3%, giving a total radiating bandwidth of 3.5%. This represents a slight reduction in bandwidth over that of the unmodified patch, as might be expected owing to the additional stored energy of the resonant circuit.

Figure 6:
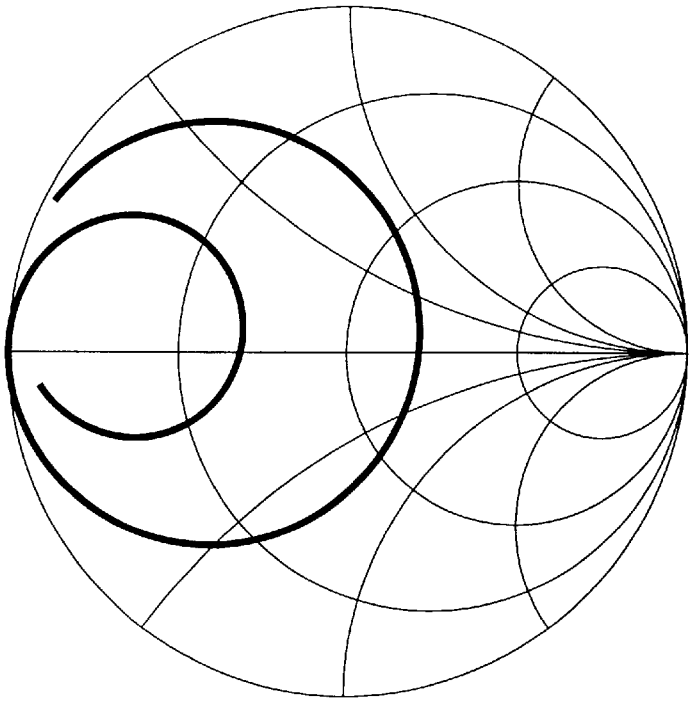
FIG. 6 is a Smith chart showing the simulated impedance of the modified equivalent circuit of FIG. 4 over the frequency range 1500 to 2000 MHz.

A Smith chart illustrating the simulated impedance of the antenna over the same frequency range is shown in FIG. 6. The match could be improved with additional matching circuitry, and the relative bandwidths of the two resonances could easily be traded, for example by changing the inductance or capacitance of the resonant circuit.

Figure 7:
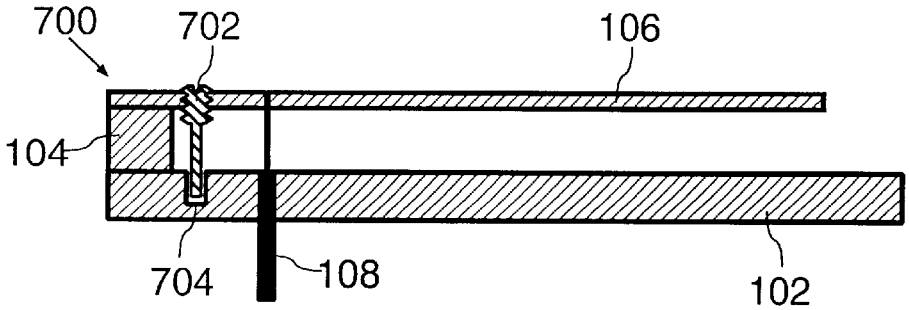
FIG. 7 is a cross-section of a modified patch antenna for dual band operation.

A prototype patch antenna was constructed to determine how well such a design would work in practice, and is shown in cross-section in FIG. 7. The modified patch antenna 700 is similar to that of FIG. 1 with the addition of a mandrel 702 and a hole 704 in the ground conductor 102. The mandrel 702 comprises an M2.5 threaded brass cylinder, which is turned down to a diameter of 1.9 mm for the lower 5.5 mm of its length, which portion of the mandrel 702 is then fitted with a 0.065 mm thick PTFE sleeve. The length of the patch conductor was reduced to 38.6 mm to correspond better to the UMTS frequency bands.

The threaded portion of the mandrel 702 co-operates with a thread cut in the patch conductor 106, enabling the mandrel 702 to be raised and lowered. The lower portion of the mandrel 702 fits tightly into the hole 704, which has a diameter of 2.03 mm. Hence, a capacitance having a PTFE dielectric is provided by the portion of the mandrel 702 extending into the hole 704, while an inductance is provided by the portion of the mandrel between the ground and patch conductors 102, 106. The mandrel is located centrally in the width of the conductors 102, 106, and its centre is located 1.7 mm from the edge of the spacer 104.

The capacitance between the mandrel 702 and hole 704 is approximately 1.8 pF per mm of penetration of the mandrel 702 into the hole 704, with a maximum penetration of 4 mm. The inductance of the 4 mm-long portion of the mandrel 702 between the conductors 102, 106 is approximately 1.1 nH.

Figure 8:
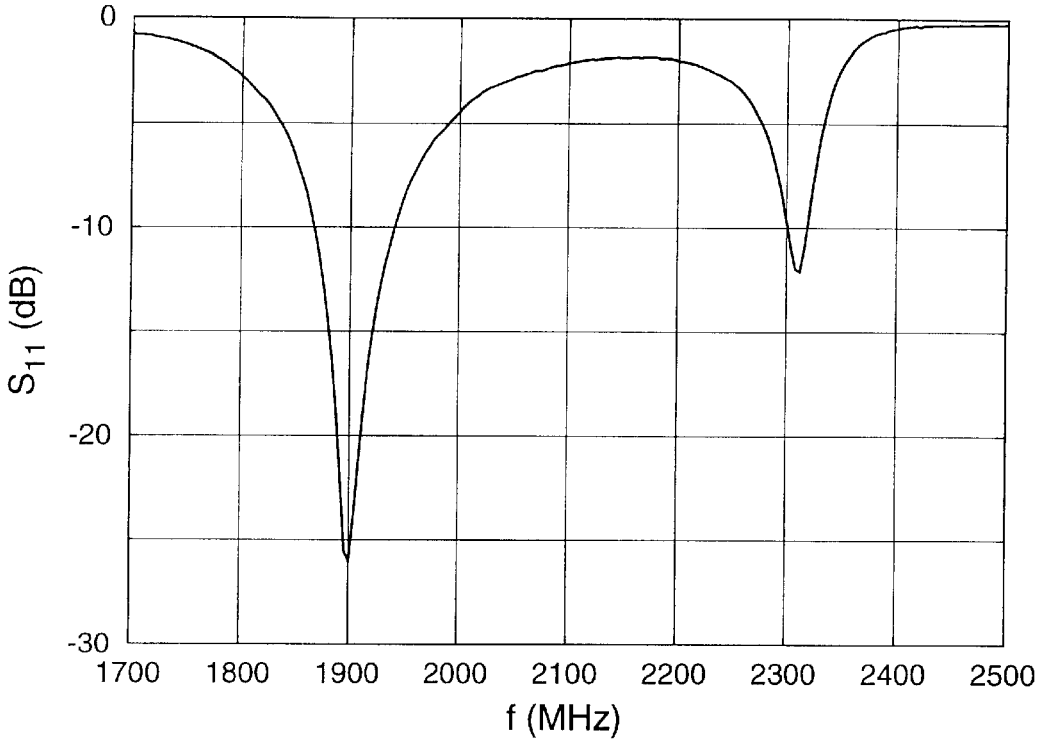
FIG. 8 is a graph of measured return loss $S_{11}$ in dB against frequency f in MHz for the patch antenna of FIG. 7.

A plot of the measured return loss $S_{11}$ for frequencies f between 1700 and 2500 MHz, with the mandrel 702 fully extended into the hole 704, is shown in FIG. 8. Dual resonance has clearly been achieved, with a fractional frequency spacing of about 14%. The 7 dB return loss bandwidths of the resonances are 5.6% and 1.7% respectively, giving a total radiating bandwidth of 7.3% which is almost double that of the unmodified patch. This improvement was quite unexpected, and makes the present invention particularly advantageous for dual band applications.

Figure 9:
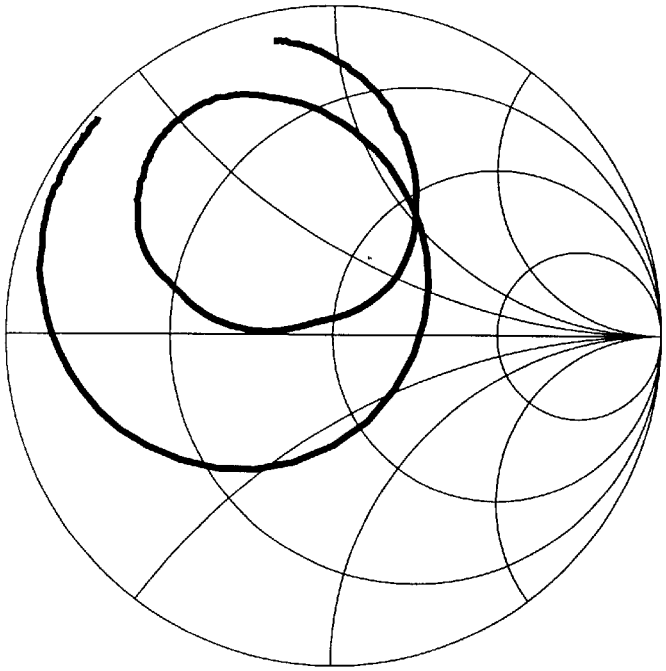
FIG. 9 is a Smith chart showing the measured impedance of the modified patch antenna of FIG. 7 over the frequency range 1700 to 2500 MHz.

A Smith chart illustrating the measured impedance, over the same frequency range, is shown in FIG. 9. This demonstrates that the impedance characteristics of two resonances of the antenna 700 are similar. Hence, simultaneous improvement of match and broadening of bandwidth appears to be possible.

Further measurements were performed with the mandrel 702 partially extended into the hole 704. As the length of the mandrel 702 in the hole 704 is reduced, the capacitance of the resonant circuit is reduced in proportion, while the inductance remains substantially constant. It was found that as the mandrel 702 was retracted from the hole 704 the resonant frequency of the second resonance increased, while that of the first resonance remained substantially constant at about 1900 MHz. The depth of both resonances reduced as the mandrel 702 was retracted. Hence, an antenna suitable for use with UMTS with a fractional frequency spacing of 8.7% could be obtained by increasing the inductance or capacitance of the resonant circuit appropriately.

In an embodiment of a patch antenna 700 suitable for mass production, the resonant circuit would typically be implemented using discrete or printed components having fixed values, while the antenna itself might be edge-fed. These modifications would enable a substantially simpler implementation than the prototype embodiment described above. An integrated embodiment of the present invention could also be made in an LTCC (Low Temperature Co-fired Ceramic) substrate, having the ground conductor 102 at the bottom of the substrate, the patch conductor 106 at the top of the substrate, and feeding and matching circuitry distributed through intermediate layers.

Figure 10:
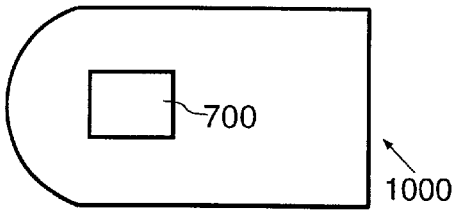
FIG. 10 is a back view of a mobile telephone handset incorporating the patch antenna of FIG. 7.

FIG. 10 is a rear view of a mobile telephone handset 1000 incorporating a patch antenna 700 made in accordance with the present invention. The antenna 700 could be formed from metallisation on the handset casing. Alternatively it could be mounted on a metallic enclosure shielding the telephone's RF components, which enclosure could also act as the ground conductor 102.

Although the embodiments described above used a resonant circuit having zero impedance at its resonant frequency, other forms of resonant circuit could equally well be used in an antenna made in accordance with the present invention. All that is required is that the behaviour of the antenna is modified by the presence of the resonant circuit in the region of its resonant frequency to generate an extra radiation mode of the antenna while leaving the original radiation mode substantially unchanged. By the addition of more resonant circuits, or the use of a resonant circuit having multiple resonant frequencies, multi-band antennas may also be designed.

From reading the present disclosure, other modifications will be apparent to persons skilled in the art. Such modifications may involve other features which are already known in the design, manufacture and use of patch antennas, and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of features during the prosecution of the present application or of any further application derived therefrom.

In the present specification and claims the word "a" or "an" preceding an element does not exclude the presence of a plurality of such elements. Further, the word "comprising" does not exclude the presence of other elements or steps than those listed.

What is claimed is:

1. A dual band patch antenna, comprising:

a patch conductor;

a ground conductor having a hole;

a conducting spacer for providing a space between said patch conductor and said ground conductor; and a mandrel including an inductive portion located within the space between said patch conductor and said ground conductor, and a capacitive portion located within said hole of said ground conductor.

2. The dual band patch antenna of claim 1, wherein said patch conductor has a threaded cut; and wherein said mandrel further includes a threaded portion cooperating with said threaded cut.

3. The dual band patch antenna of claim 1, further comprising:

a co-axial cable including an inner conductor connected to said patch antenna and located within said space of said patch conductor; and an outer conductor connected to said inner conductor and extending through said ground conductor.

4. The dual band patch antenna of claim 3, wherein said inductive portion of said mandrel is positioned between said spacer and said inner conductor.

5. A dual band patch antenna, comprising:

a patch conductor layer;

a ground conductor layer overlying said patch conductor layer, said ground conductor layer having a hole; and a resonant circuit including a first set of one or more layers forming an inductor located between said patch conductor layer and said ground conductor layer, and a second set of one or more layers forming a capacitor located within said hole of said ground conductor layer.

6. A dual band patch antenna, comprising:

a patch conductor;

a ground conductor; and a first resonant circuit connected to said patch conductor and unconnected to said ground conductor, wherein said ground conductor has a hole, and wherein said first resonant circuit includes a mandrel having a capacitive portion located within said hole.

7. The dual band patch antenna of claim 6, wherein said patch conductor has a threaded cut; and wherein said first resonant circuit includes a mandrel having a threaded portion in cooperation with said threaded cut.

8. The dual band patch antenna of claim 6, wherein a space is defined between said patch conductor and said ground conductor; and wherein said first resonant circuit includes a mandrel having, an inductive portion located within the space between said patch conductor and said ground conductor.

9. The dual band patch antenna of claim 6, further comprising:

a second resonant circuit connected to said patch conductor and unconnected to said ground conductor, wherein said second resonant circuit is electrically coupled to said ground conductor.

10. The dual band patch antenna of claim 6, further comprising:

a second resonant circuit connected to said patch conductor and connected to said ground conductor.

11. The dual band patch antenna of claim 10, further comprising:

a conducting spacer for providing a space between said patch conductor and said ground conductor, wherein said first resonant circuit is located between said conducting spacer and said second resonant circuit.

* * * * *